US009994421B2

(12) United States Patent
Talonen et al.

(10) Patent No.: US 9,994,421 B2
(45) Date of Patent: Jun. 12, 2018

(54) ARRANGEMENTS FOR MAINTAINING FAVORITE FLOOR LISTS IN ELEVATOR SYSTEMS

(71) Applicants: Tapani Talonen, Tervakoski (FI); Tommi Huotari, Riihimaki (FI)

(72) Inventors: Tapani Talonen, Tervakoski (FI); Tommi Huotari, Riihimaki (FI)

(73) Assignee: Kone Corporation, Helsinki (FI)

( * ) Notice: Subject to any disclaimer, the term of this patent is extended or adjusted under 35 U.S.C. 154(b) by 523 days.

(21) Appl. No.: 14/623,420

(22) Filed: Feb. 16, 2015

(65) Prior Publication Data

US 2015/0158693 A1 Jun. 11, 2015

Related U.S. Application Data

(63) Continuation of application No. PCT/FI2013/050897, filed on Sep. 17, 2013.

(30) Foreign Application Priority Data

Sep. 26, 2012 (FI) ..... 20126005

(51) Int. Cl.
*G10D 9/04* (2006.01)
*B66B 1/24* (2006.01)
(Continued)

(52) U.S. Cl.
CPC ..... *B66B 1/2408* (2013.01); *B66B 1/468* (2013.01); *B66B 19/007* (2013.01); *B66B 2201/463* (2013.01); *B66B 2201/4653* (2013.01)

(58) Field of Classification Search
CPC ..... B66B 1/2408; B66B 1/468; B66B 19/007; B66B 2201/463; B66B 2201/4653
(Continued)

(56) References Cited

U.S. PATENT DOCUMENTS 5,949,037 A 9/1999 Oya
6,202,799 B1 3/2001 Drop
(Continued)

FOREIGN PATENT DOCUMENTS

CN 1240755 A 1/2000
CN 1362934 A 8/2002
(Continued)

OTHER PUBLICATIONS

Extended European Search Report dated May 13, 2016 issued in corresponding European Application No. 13842117.7.
(Continued)

*Primary Examiner* — Jeffrey Donels
(74) *Attorney, Agent, or Firm* — Harness, Dickey & Pierce, P.L.C.

(57) ABSTRACT

The present invention discloses a solution for maintaining passenger-specific favorite floor lists in an elevator system, which comprises at least one elevator, call-giving devices for registering calls given by the passengers, a control system that is responsive to the aforementioned calls and memory means, in which is recorded at least one passenger-specific favorite floor list. A passenger is identified in connection with giving a call on the basis of the ID number of an identifier. The favorite floor list is updated on the basis of calls given by the passenger and/or a given updating criterion.

14 Claims, 2 Drawing Sheets

Figure 1:
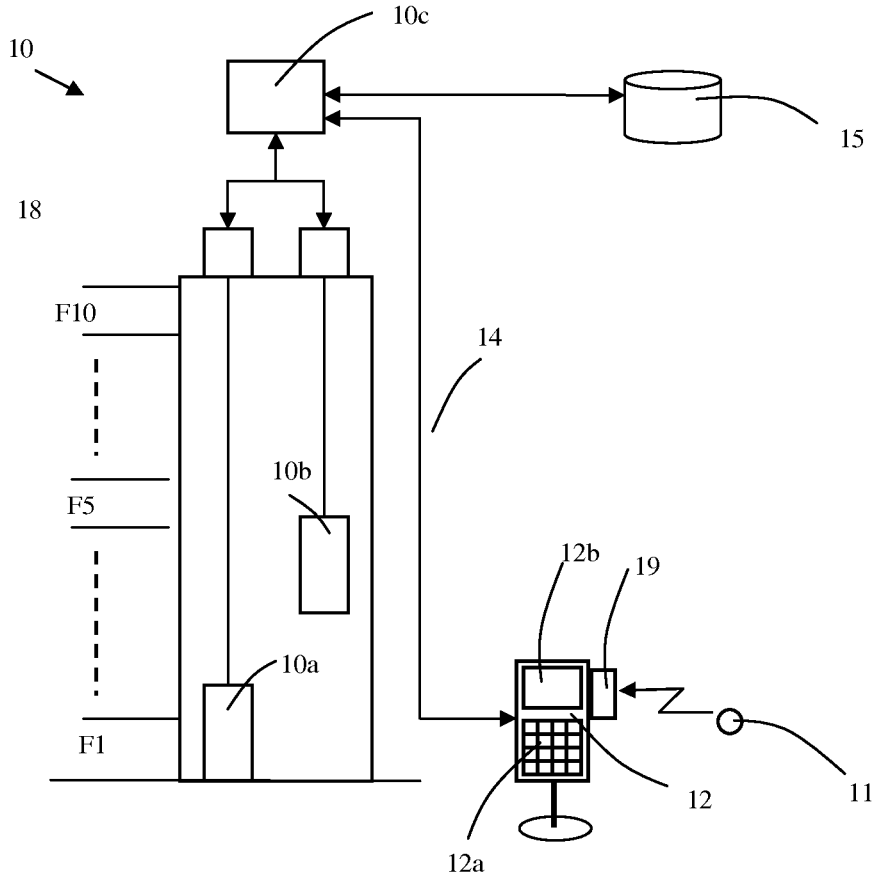

(51) Int. Cl.
*B66B 1/46* (2006.01)
*B66B 19/00* (2006.01)

(58) Field of Classification Search
USPC ..... 181/391
See application file for complete search history.

(56) References Cited

U.S. PATENT DOCUMENTS

| | | | | |
|---|---|---|---|---|
| 6,209,685 | B1 | 4/2001 | Zaharia et al. | |
| 7,353,915 | B2 | 4/2008 | Zaharia et al. | |
| 7,377,364 | B2 * | 5/2008 | Tyni | B66B 1/468 187/380 |
| 7,882,938 | B2 * | 2/2011 | Blackaby | B66B 1/34 187/384 |
| 7,958,971 | B2 * | 6/2011 | Mangini | B66B 1/463 187/380 |
| 8,584,811 | B2 * | 11/2013 | Kuoppala | B66B 1/468 187/316 |
| 9,045,314 | B2 * | 6/2015 | Finschi | B66B 1/467 |
| 2006/0065490 | A1 | 3/2006 | Zaharia et al. | |
| 2007/0151809 | A1 | 7/2007 | Tyni et al. | |
| 2008/0011557 | A1 | 1/2008 | Hakala et al. | |
| 2013/0248300 | A1 | 9/2013 | Rusanen et al. | |
| 2016/0221791 | A1 * | 8/2016 | Berryhill | B66B 1/468 |

FOREIGN PATENT DOCUMENTS

| | | | |
|---|---|---|---|
| JP | 2005162465 | A | 6/2005 |
| WO | WO-0102279 | A1 | 1/2001 |
| WO | WO-2012/059639 | A1 | 5/2012 |

OTHER PUBLICATIONS

Chinese Office Action dated Jan. 4, 2016 issued in corresponding Chinese Application No. 2013800486916.
International Search Report for PCT/FI2013/050897 dated Nov. 15, 2013.
Finnish Search Report for FI20126005 dated Feb. 6, 2013.
Written Opinion of the International Searching Authority PCT/ISA/237 for International Application No. PCT/FI2013/050897 dated Nov. 15, 2013.

* cited by examiner

ARRANGEMENTS FOR MAINTAINING FAVORITE FLOOR LISTS IN ELEVATOR SYSTEMS

This application is a continuation of PCT International Application No. PCT/FI2013/050897 which has an International filing date of Sep. 17, 2013, and which claims priority to Finnish patent application number 20126005 filed Sep. 26, 2012, the entire contents of both of which are incorporated herein by reference.

FIELD OF THE INVENTION

The invention relates to elevator systems. More particularly the invention relates to a method and to an elevator system for maintaining passenger-specific lists of favorite floors.

BACKGROUND OF THE INVENTION

With regard to elevator systems, a call-giving method is known in which a passenger can give a so-called destination call to an elevator system by means of an identifier, e.g. by means of an RFID identifier (Radio Frequency Identifier) in his/her possession. The elevator system must in this case be provided with reader units, which read the data contained by the identifier (so-called identification data) and transmit it to the elevator system. On the basis of the identification data the elevator system determines the destination floor specific to the passenger and allocates from the elevator system an elevator for taking the passenger to the floor in question. The destination floor can be e.g. a floor on which the workpoint or apartment of the passenger is situated. If the reader unit is in an elevator car, the passenger can give a destination call also in the elevator car in the manner described above. Often access control is also connected to the aforementioned prior-art solutions in such a way that for each passenger information about those destination floors in the building to which the passenger has an access right is recorded in the elevator system or in a special access control system.

A number of drawbacks are, however, connected to the call-giving solutions described above. The information to be connected to the identifier of a passenger, such as the destination floors to be connected to automatic calls (so-called default floors), must be manually configured into the elevator system or into an access control system in connection with the elevator system. Configuration is generally performed by the system administrator, which increases the maintenance costs of the system and in general hampers the flexible use of identifiers. Also, in situations in which a resident or other constant visitor to the building ceases visiting the building, his/her information must be removed from the aforementioned elevator system or access control system manually. In solutions according to prior art the default floors are generally one per passenger, which the passenger cannot himself/herself change. The solutions are therefore poorly suited to situations in which a passenger has a number of favorite floors, to which he/she from time to time wants to travel.

AIM OF THE INVENTION

The aim of the present invention is to eliminate or at least to alleviate the drawbacks presented above that occur in prior-art solutions. The aim of the invention is also to achieve one or more of the following objectives:

- a self-learning system, which automatically maintains/updates the favorite floor lists of each passenger for presentation to the passenger in connection with giving a call,
- to facilitate and speed up travel in an elevator system,
- to reduce the maintenance costs of an elevator system and/or of an access control system,
- a dynamic system, which adapts automatically to changes occurring in the travel habits of a passenger, and
- a solution that is easy to add to/modernize in existing elevator systems.

SUMMARY OF THE INVENTION

The method according to the invention is characterized by what is disclosed in the characterization part of claim 1. The elevator system according to the invention is characterized by what is presented in the characterization part of claim 7. Other embodiments of the invention are characterized by what is disclosed in the other claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

The present invention also discloses a method for maintaining favorite floor lists in an elevator system, which comprises at least one elevator, call-giving devices for registering calls given by the passengers, a control system that is responsive to the aforementioned calls, and memory means, in which is recorded at least one passenger-specific favorite floor list, and in which method a passenger is identified in connection with giving a call. In the method the passenger-specific favorite floor list is updated on the basis of calls given by the passenger and/or given updating criteria. A call refers in this context to a destination call given outside the elevator and also to a destination call given in an elevator car. A favorite floor list means a list in which there is at least one destination floor, a so-called favorite floor, related to the registered calls of a user. Updating of a favorite floor list means in this context that a new favorite floor is added to the favorite floor list and/or a favorite floor already on the favorite floor list is removed and/or the sequence of favorite floors is changed in the favorite floor list. A favorite floor list is updated on the basis of a given updating criterion, which is e.g. one or more of the following rules:

- the destination floors to which a passenger has last traveled are added to the favorite floor list and, if necessary, the oldest favorite floors, to which the passenger has not given calls, are removed.
- the destination floors to which a passenger has made the most elevator journeys in a certain time period, e.g. during the last 30 days, are added to the favorite floor list. If necessary, the favorite floors to which the passenger has given the least calls in the aforementioned time period are removed from the favorite floor list.

a favorite floor is removed from the favorite floor list, if the given time limit from the previous call by a passenger to the favorite floor in question has expired;

all the data related to the favorite floor lists of a passenger is removed from the memory of the elevator system, if the passenger has not given a single elevator call within a given time limit.

A passenger is identified when the passenger is at a call-giving device/in an elevator lobby ready to give his/her call. Any identification technology whatsoever suited to the purpose can be used for identifying a passenger, such as e.g. a personal RFID identifier, a code sent by a mobile phone and/or a bio-identifier. For reading the identification data contained by an identifier, the elevator system, e.g. the call-giving devices (call panels), is/are provided with suitable reader units.

The basic concept of the invention is that the elevator system, or a system in connection with it, records data about the journeys made by a passenger, on the basis of the data forms favorite floor lists, which the system maintains automatically on the basis of the desired updating criteria. When a passenger is identified before registration of a call, the elevator system presents the call-giving pushbuttons according to the favorite floor list (i.e. to favorite floors) e.g. in a highlighted manner compared to the other call-giving pushbuttons (i.e. to other than favorite floors). A stronger light intensity and/or a variation in light intensity (i.e. flashing) of text/a symbol connected to a pushbutton can be used as highlighting.

In one embodiment of the invention favorite floor lists specific to departure floors and/or specific to periods of time are formed. From the favorite floor lists formed the active favorite floor list is selected on the basis of the departure floor of the passenger and/or of the calendar time. Only the active favorite floor list is shown to passenger on a call-giving device and is updated on the basis of a call given by the passenger. As a result of the embodiment, the optimal favorite floor list can be shown to a passenger regardless of from which floor and when he/she requests elevator service.

In one embodiment of the invention the elevator system comprises a number of elevator groups, among which the favorite floor lists are distributed. As a result of the embodiment, a passenger has in his/her use the same favorite floor lists regardless of which elevator group he/she uses in the building.

The present invention also discloses an elevator system, which comprises at least one elevator, call-giving devices for registering calls given by the passengers, a control system that is responsive to the aforementioned calls, means for identifying a passenger in connection with giving a call and also memory means, in which is recorded at least one passenger-specific favorite floor list. According to the invention the elevator system is arranged to update the aforementioned favorite floor list on the basis of calls given by a passenger and/or a given updating criterion.

With the solution according to the invention numerous advantages are achieved compared to prior-art solutions. The elevator system according to the invention is a self-learning system and does not therefore require human resources for configuring or maintaining passenger-specific favorite floors. The teaching of favorite floors is based on elevator journeys made by the passenger himself/herself, making the system easy-to-use and flexible. The system according to the invention adapts to changes occurring in the travel habits of a passenger by updating the favorite floor lists automatically. As a result of the invention a favorite floor list does not grow unreasonably, because favorite floors generated by journeys made randomly/seldom are removed from it. As a result of the invention information about people who will presumably no longer use the elevator system according to the invention is removed automatically from the system, and does not therefore load the system unnecessarily. On the whole travel in an elevator system according to the invention is speeded up and facilitated by updating personal favorite floor lists and by indicating the call buttons relating to them clearly and differently from the other call buttons in connection with call-giving. In this context, reference is also made to the other advantages to be achieved with the invention, which are presented above in connection with the different embodiments.

LIST OF FIGURES

In the following, the invention will be described in detail by the aid of some examples of its embodiments, wherein:

FIG. 1 presents one elevator system according to the invention, and

Figure 2:
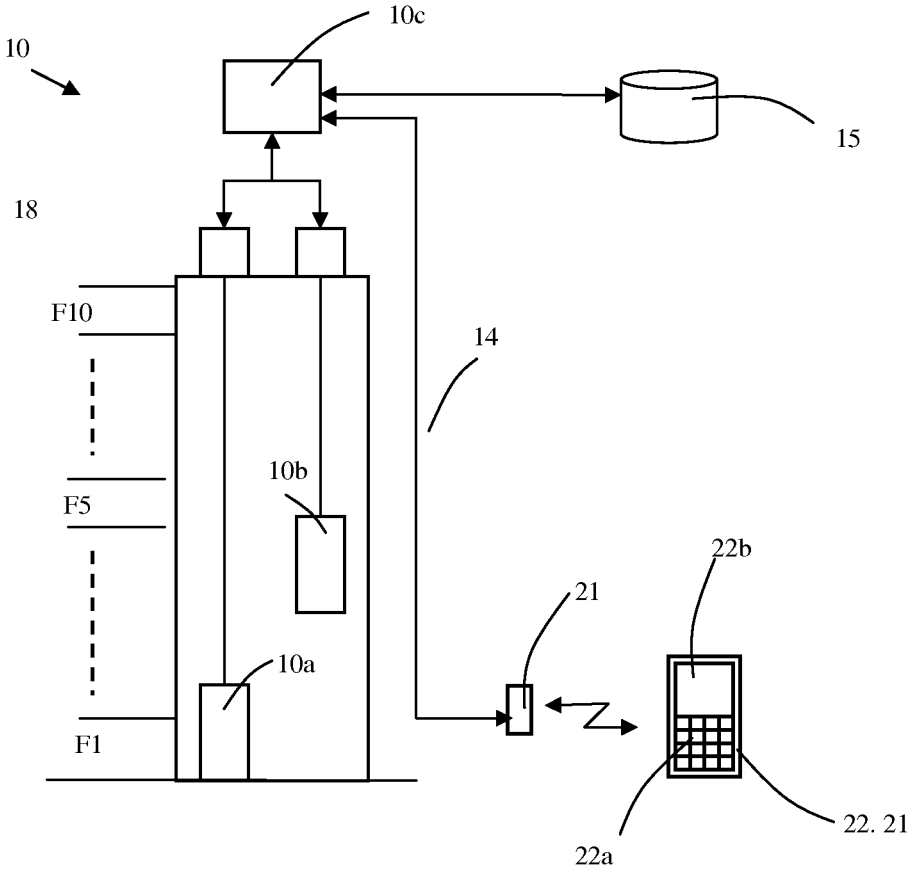

FIG. 2 presents a second elevator system according to the invention.

DETAILED DESCRIPTION OF THE INVENTION

FIG. 1 presents one elevator system 10 according to the invention, which comprises the elevators 10*a* and 10*b*, a control system 10*c* of the elevator system, call-giving devices 12 connected to the control system 10*c* for registering calls given by the passengers and also memory means 15 in connection with the control system, in which memory means passenger-specific favorite floor lists are recorded. A personal identifier 11 is given for the use of a passenger, which identifier is e.g. an RFID identifier and the identification data contained by which can be read with reader units 19 in connection with the call-giving device 12. The reading distance is preferably so long that the reader unit can read the identification data when the identifier 11 is e.g. in the pocket of a passenger. The identification data contains e.g. an individual ID number, which ID number the reader unit 14 reads and transmits to control system 10*c*. Call-giving devices 12 and reader units 19 can also be disposed in the elevator cars (not presented in FIG. 1). The memory means 15 can also be distributed into one or more call-giving devices 12 in such a way that in each call-giving device there are the favorite floor lists of at least one passenger, the updating of which lists is managed by the call-giving device in question. As a result of the distribution of the memory means it is easy to provide the elevator system with a solution according to the invention by modernizing only the call-giving devices without modernizing the rest of the apparatus belonging to the elevator system, e.g. the control system 10*c*.

The call-giving devices 12 are preferably destination operating panels implemented with touch-sensitive displays. FIG. 1 presents only the destination operating panel 12 on floor F1 (entrance lobby floor), which panel can present in the display unit 12*b* the desired call buttons 12*a* and, if necessary, other information relating to call-giving. The call-giving devices and/or the reader devices are connected to the control system via a wireline or wireless data transfer connection 14.

When the holder (a passenger) of an identifier 11 arrives in the entrance lobby F1 of a building, he/she goes to the call-giving device 12, in which case the reader device 19 reads the ID number of the identifier 11. The control system receives the ID number and, on the basis of it, retrieves from the memory means 15 the favorite floor list (so-called active favorite floor list) of the passenger. The favorite floor list could have been preliminarily entered into the memory means 15 manually or a first favorite floor could have been generated on the basis of the first call given by the passenger.

On the basis of the favorite floor list the control system configures the call-giving device 12 in such a way that at least some of the call pushbuttons 12*a* of favorite floors are presented on the call-giving device highlighted compared to the call pushbuttons of the other floors. Owing to the highlighting a passenger quickly finds the correct call pushbutton, if he/she is going to any of his/her favorite floors.

If a passenger is going to some other floor than his/her favorite floor, he/she can give his/her call with "non-highlighted" call pushbuttons.

One task of the control system 10*c* is to update the passenger-specific favorite floor lists on the basis of calls given by passengers and/or given updating criteria, e.g.:

- the control system adds to the favorite floor list a destination floor to which a passenger has last traveled and which is not yet on the favorite floor list. At the same time the control system removes from the favorite floor list a favorite floor to which the last journey made by the passenger was the longest time ago. The maximum length of a favorite floor list is in this way kept constant, containing e.g. 10 favorite floors.
- the control system counts the numbers of elevator journeys/calls made by the passenger to different destination floors during a certain period of time, e.g. during the last 30 days. Based on the numbers the control system updates the favorite floor list in such a way that the destination floors to which the passenger has given most calls are on the list. The maximum length of the favorite floor list is set e.g. to ten favorite floors.
- The control system removes a favorite floor if the given time limit from the previous call by a passenger to the favorite floor in question has expired.
- the control system removes from the memory means all the data related to the favorite floor lists of a passenger, if the passenger has not given a single call to the elevator system within a given time limit.

In the example presented above reader units 14 are in connection with the call-giving devices 12 in the elevator lobbies, which reader units read the identification data contained by the identifiers 11 in the possession of passengers. The control system has information about the location of the reader units, so it can deduce in which elevator lobby of which floor (departure floor) and at which call-giving device the passenger is at any given time and can utilize the information in the selection of a favorite floor list, such as e.g. if the favorite floors are specific to the departure floor. In this embodiment the control system maintains per each departure floor its own favorite floor list, which it updates depending on the departure floors on which a call of the passenger is registered. For example, in the elevator system according to FIG. 1 the elevator serves the floors F1, F2 . . . F10, so each passenger can have 10 favorite floor lists, from which the favorite floor list corresponding to the departure floor of the passenger is selected as the active favorite floor list.

According to a second embodiment of the invention the favorite floor lists are time-based. In this embodiment the control system maintains with the memory means favorite floor lists for a passenger, one of which lists is selected as the active favorite floor list depending e.g. on the time of day and/or on the day of the week.

FIG. 2 presents a second embodiment of the invention wherein a terminal device 22, such as e.g. a mobile phone, in the personal use of a passenger functions as a call-giving device, which is provided with e.g. a touch-sensitive display 22*a* and also with application software for utilizing favorite floor lists. A reader device 29 is e.g. a Bluetooth base station or some other reader device applicable to wireless data transfer, which device receives an ID number, e.g. the phone number of a mobile phone, sent by the terminal device 22. In this embodiment favorite floor lists can be recorded in the manner described above in the memory means 15 but are transmitted to a terminal device and presented to a passenger in the call-giving phase on the display 22*b* of the terminal device. Alternatively passenger-specific favorite floor lists can be recorded in the memory 25 of a terminal device and they can be updated in the manner described above.

According to one embodiment of the invention the favorite floor lists are distributed among two or more elevator groups. In this embodiment the elevator groups can have a common memory means 15, in which the elevator groups (group controls) have reading rights and writing rights, or the passengers have terminal devices 22, in the memories 25 of which passenger-specific favorite floor lists are maintained.

The invention is not only limited to be applied to the embodiments described above, but instead many variations are possible within the scope of the inventive concept defined by the claims. Thus, for example, the control system 10*c* can comprise one or more control apparatuses.

The invention claimed is:

1. A method for maintaining a favorite floor list in an elevator system, the elevator system including at least one elevator, call-giving devices, and a memory the method comprising:

identifying a passenger based on destination calls given by the passenger, the destination calls indicating destination floors desired by the passenger from among floors associated with the elevator system; and updating the favorite floor list based on one or more of the destination calls and a given updating criterion, the favorite floor list indicating favorite ones of the destination floors, the updating including, storing, in the favorite floor list, the destination floors and call times associated with the destination calls from the passenger, and removing, in the favorite floor list, an unused floor from among the favorite ones of the destination floors, if a latest one of the call times associated with the unused is older than a threshold.

2. The method according to claim 1, wherein the updating updates the favorite floor list based on a most recent one of the destination calls given by the passenger.

3. The method according to claim 1, further comprising :

counting a number of the destination calls to different one of the destination floors over a given period of time, wherein the updating updates the favorite floor list based on the number of the destination calls.

4. The method according to claim 1, wherein the updating comprises:

deleting the favorite floor list of the passenger, if a latest one of the destination calls associated with the passenger occurred past a given time limit.

5. The method according to claim 1, wherein the updating updates the favorite floor list such that the favorite floor list is specific to departure floors and/or periods of time.

6. An elevator system, comprising:

call-giving devices configured to register destination calls for at least one elevator given by a passenger, the destination calls indicating destination floors desired by the passenger from among floors associated with the elevator system;

a sensor configured to read the identification data of an identifier in possession of the passenger;

a memory configured to store a favorite floor list associated with the passenger, the favorite floor list indicating favorite ones of the destination floors; and a controller configured to update the favorite floor list based on one or more of the destination calls and a given updating criterion by, storing, in the favorite floor list, the destination floors and call times associated with the destination calls from the passenger, and removing, in the favorite floor list, an unused floor from among the favorite ones of the destination floors, if a latest one of the call times associated with the unused is older than a threshold.

7. The elevator system according to claim 6, wherein the controller to set one or more call pushbuttons of the call-giving devices to a highlighted state based on the favorite floor list.

8. The elevator system according to claim 6, wherein the sensor includes sensors installed in elevator lobbies and/or elevator cars.

9. The elevator system according to claim 6, wherein the memory is distributed into one or more of the call-giving devices.

10. The elevator system according to claim 6, wherein the controller is configured to update the favorite floor list based on a most recent one of the destination calls given by the passenger.

11. The elevator system according to claim 6, wherein the controller is configured to, count a number of the destination calls to different one of the destination floors over a given period of time, and update the favorite floor list based on the number of the destination calls.

12. The elevator system according to claim 6, wherein the controller is configured to delete the favorite floor list of the passenger, if a latest one of the destination calls associated with the passenger occurred past a given time limit.

13. The elevator system according to claim 6, wherein the controller is configured to update the favorite floor list such that the favorite floor list is specific to departure floors and/or periods of time.

14. The method according to claim 1, further comprising:

setting one or more call pushbuttons of the call-giving devices to a highlighted state based on the favorite floor list.

* * * * *